US005405021A

United States Patent [19]

Smithson

[11] Patent Number: 5,405,021

[45] Date of Patent: Apr. 11, 1995

[54] DISPENSERS

[75] Inventor: Martin D. Smithson, Worcestershire, Great Britain

[73] Assignee: Dispense A Bag Systems Limited, Buckinghamshire, United Kingdom

[21] Appl. No.: 101,241

[22] Filed: Aug. 2, 1993

[30] Foreign Application Priority Data

Aug. 3, 1992 [GB] United Kingdom ..... 9216469

[51] Int. Cl.[6] ..... A47F 7/00

[52] U.S. Cl. ..... 211/50; 206/554

[58] Field of Search ..... 211/50; 248/95; 206/554, 555, 449, 493, 499; 221/26, 45, 47, 59, 61, 63

[56] References Cited

U.S. PATENT DOCUMENTS

| | | | |
|---|---|---|---|
| 3,896,966 | 7/1975 | Canno | 206/554 X |
| 4,674,635 | 6/1987 | Huldin et al. . | |
| 4,805,969 | 2/1989 | Heacock | 206/554 X |
| 5,255,883 | 10/1993 | Greenfield et al. | 248/95 |
| 5,269,423 | 12/1993 | Nguyen | 206/554 |
| 5,301,832 | 4/1994 | Daniels | 206/554 X |

FOREIGN PATENT DOCUMENTS

| | | | |
|---|---|---|---|
| 1539708 | 10/1968 | France | 206/554 |
| 2215306 | 9/1989 | United Kingdom . | |

*Primary Examiner*—Robert W. Gibson, Jr.

*Attorney, Agent, or Firm*—Sterne, Kessler, Goldstein & Fox

[57] ABSTRACT

The present invention is a dispenser for dispensing individual pre-formed stacked bags or sheets. The dispenser includes a casing and an anchor plate releasably engaged within the casing. A catch means secured to the underside of the anchor plate engages with a hole in the stack of bags or sheets. The bags or sheets are folded once around the edge of the anchor plate so that the free ends of the bags or sheets project from the mouth of the casing. Individual bags or sheets can be detached at the free end of the stack by pulling the bag or sheet away from the dispenser. Detachment of more than a few bags at a time is made difficult by frictional effects in the stack. An alternative arrangement in which the anchor plate is fixedly mounted to a base is also described.

10 Claims, 2 Drawing Sheets

DISPENSERS

FIELD OF THE INVENTION

This invention relates to dispensers for dispensing preformed bags or sheets at points of use.

BACKGROUND OF THE INVENTION

It is common practice to provide, for example in supermarkets and other retail outlets or at work stations, dispensers for dispensing pre-formed bags or sheets at points of use. One such dispenser holds a roll of bags pre-formed along the length of the roll, the bags being obtainable from the dispenser by pulling each bag and tearing it from the roll along a perforated strip. Such a dispenser when loaded with a full roll is bulky and it can be difficult to remove the individual bags. These problems also arise with rolls of sheets having perforated strips between individual sheets. As an alternative to rolls, stacks of individual pre-formed bags or sheets are available from which it is a simpler task to remove and open individual bags or sheets. The present invention is concerned with a dispenser for such stacks of individual pre-formed bags or sheets.

BRIEF DESCRIPTION OF THE INVENTION

According to the present invention there is provided a dispenser for dispensing individual pre-formed bags or sheets from a stack of such bags or sheets, the dispenser comprising a body part and an anchor part for the stack disposed on or in the body part, the anchor part comprising catch means for engaging a stack of pre-formed bags or sheets and stack support means for underlying and supporting a portion of the engaged stack, whereby the anchor part is adapted to have a stack of pre-formed bags or sheets that is engaged with the catch means folded around the support means so that this stack extends from the catch means, passes over and around the support means so that free ends of the bags or sheets project from the dispenser for being grasped for removal.

DETAILED DESCRIPTION OF THE INVENTION

The anchor part suitably comprises an anchor plate carrying on one of its faces the catch means and extending from the catch means to define the support means for the stack.

In a preferred embodiment the anchor part is releasably mountable to the body (the body suitably comprising a casing having a mouth for receiving the anchor part and typically engaging it within the casing to prevent accidental removal), the arrangement being such that in use the stack of bags or sheets extends from the catch means away from the mouth of the casing, around the stack support means and back to the mouth of the casing so that the free ends of the bags or sheets project out of the mouth of the casing for being grasped for removal.

Such a dispenser in which the anchor part is an anchor plate carrying the catch means can be simply loaded by removing the anchor plate from the casing, engaging a stack of pre-formed bags or sheets with the catch means, folding the stack once around one edge of the anchor plate and reinserting the anchor plate in the casing so that the free ends of the bags or sheets project from the mouth of the casing.

The casing is typically mounted to a fixed support, suitably via conventional brackets provided on the casing exterior. By selecting the desired bracket configuration, the dispensers (particularly smaller ones) may be mounted at an angle or in a horizontal orientation. The casing suitably has side, upper and lower walls defining the mouth and can conveniently be disposed so as to retain the anchor plate substantially parallel to the upper and lower walls in whatever orientation the dispenser may be mounted.

The anchor plate may carry flanges that releasably engage with cooperating formations provided on the walls of the casing when the parts are properly and fully assembled together.

The catch means can be located so as to be at or near the mouth of the casing, and preferably to the underside of the anchor plate, when the anchor plate is mounted in the casing.

The catch means can be suitably disposed L-shaped pins or a projecting plate of generally L-shaped cross-section engageable in one or more holes appropriately provided in the stack of bags or sheets.

The anchor plate can be a sliding fit in the casing and can have side wings that slidingly engage side walls of the casing. The side wings may serve as guides for guiding the stack of bags or sheets over and around the anchor plate.

In a further embodiment, the anchor part may be fixedly disposed on the body part, the body part comprising a base part from which the anchor part including the stack support means extends and the catch means being provided relatively close to the base part, the arrangement being such that in use the stack of bags or sheets extends from the catch means away from the base part of the dispenser and passes over and around the stack support means to hang over the support means for being grasped for removal.

In such an arrangement the anchor part may be integral with, or permanently mounted to, the body part of the dispenser, and the stack support means (e.g. an anchor plate) may suitably extend upwards at an angle to the vertical, e.g. a relatively steep angle. The catch means is conveniently provided on the upper face of the anchor plate (in the case where the plate is at an angle to the vertical) and relatively close to the point at which the anchor plate projects from the body of the dispenser. The arrangement is typically such that in use the stack of bags or sheets extends from the catch means away from the body of the dispenser, around the end (e.g. the upper edge) of the anchor plate to hang over the end of the anchor plate for being grasped for removal. The anchor plate can have side wings that serve as guides for guiding the stack of bags or sheets over and around the anchor plate. The upper edge of the anchor plate is suitably positioned so that the free ends of the bags or sheets are readily accessible to the user, for example a shop assistant or supermarket check-out operator.

BRIEF DESCRIPTION OF THE DRAWINGS

For a better understanding of the invention and to show how the same may be carried into effect, reference will now be made, by way of example, to the accompanying drawings, in which.

DETAILED DESCRIPTION OF THE DRAWINGS

Figure 1:
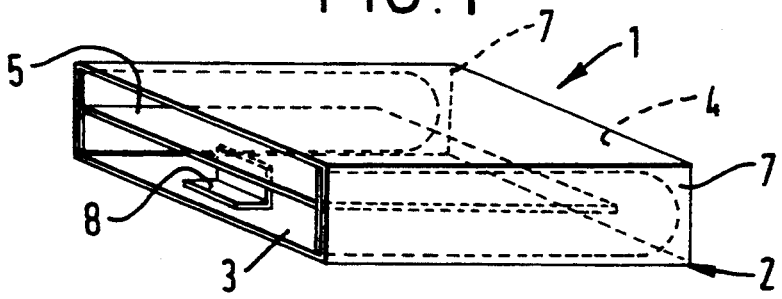
FIG. 1 is a perspective view of a dispenser for dispensing pre-formed bags or sheets.

The dispenser of FIG. 1 has a body part in the form of a casing 2 which as illustrated is a rectangular sleeve having an open mouth 3. This sleeve is closed, opposite the mouth 3, by a wall 4 which can be provided with an arrangement (not shown) for mounting the dispenser, for example, on a wall. Within the casing 2 there is the anchor plate 5 (FIG. 2).

Figure 2:
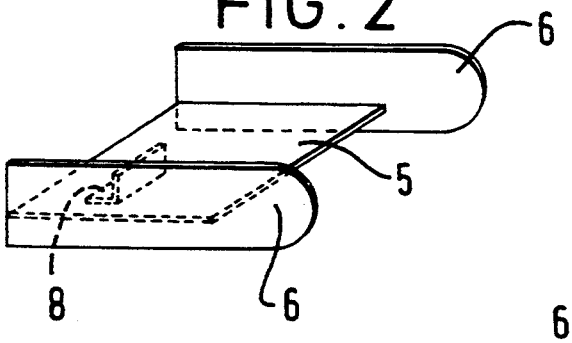
FIG. 2 is a perspective view of an anchor plate of the dispenser of FIG. 1.

Referring to FIG. 2, the anchor plate 5 has side wings 6,6 which slidingly engage corresponding side walls 7,7 of the casing 2 to hold the anchor plate 5 as a sliding fit in the casing 2 with the plate 5 extending across the casing 2. The wings 6,6 also serve as guide pieces to guide the stack of bags or sheets over and around the anchor plate 5. The anchor plate carries an L-shaped catch member 8 which depends from the anchor plate 5 and projects towards the mouth 3 of the casing 5.

Figure 3:
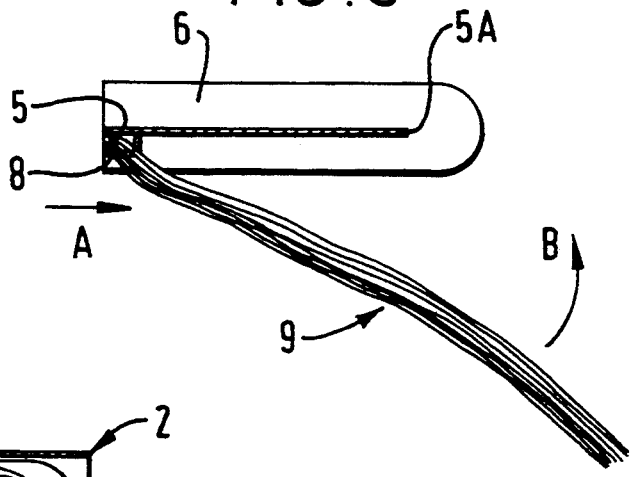
FIG. 3 is a sectional side view of the anchor plate of FIG. 2 showing how a stack of pre-formed bags or sheets is mounted thereon.
Figure 4:
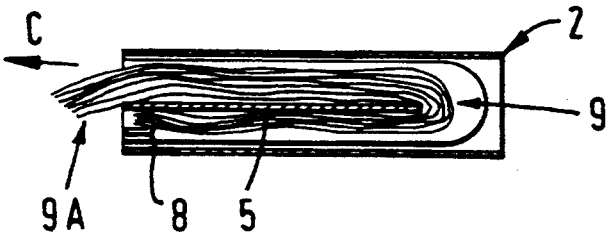
FIG. 4 is a sectional side view of the dispenser shown loaded with the stack of pre-formed bags or sheets, ready for removal one-by-one, FIG. 5(*a*) is a perspective view of the anchor plate of an alternative configuration, FIG. 5(*b*) is a perspective view of a casing for use with the alternative anchor plate shown in FIG. 5(*a*)

Turning to FIGS. 3 and 4, the stack 9 of pre-formed bags or sheets is loaded into the dispenser 1 by removing the empty anchor plate 5 from the casing 2; engaging holes provided in the stack 9 on the pins 8,8 and sliding the stack onto the catch 8 (arrow A in FIG. 3); folding the stack 9 in two around the edge 5A of the plate 5 remote from the catch 8 (arrow B in FIG. 3); and sliding the anchor plate 5 with the stack 9 folded in two around it into the casing 2 through the casing mouth 3 and so as to leave the free ends 9A of the stack 9 projecting from the container mouth 3. The bags or sheets can then be removed from the dispenser one at a time by grasping the free end and pulling the bag or sheet from the dispenser (arrow C in FIG. 3).

Preferably the thickness of the stack 9 initially is such that the stack has to be compressed in order to slide the anchor plate into the casing. There is then an increased tendency for the free ends of the bags or sheets to feather where they project from the casing 9, facilitating removal of the bags or sheets individually from the dispenser.

There can be an upstanding lip (not shown) at the mouth 3 of the casing 2 that is engaged by the free ends of the catch 8 to retain the anchor plate 5 in the casing, the catch being lifted over this lip when the anchor plate 5 is removed. Additional, or alternative, retaining arrangements can be provided elsewhere, or the anchor plate 5 can be a sufficiently tight fit in the casing 2 as normally to remain within the casing but so as to be removable by application of higher than normal force.

Figure 5B:
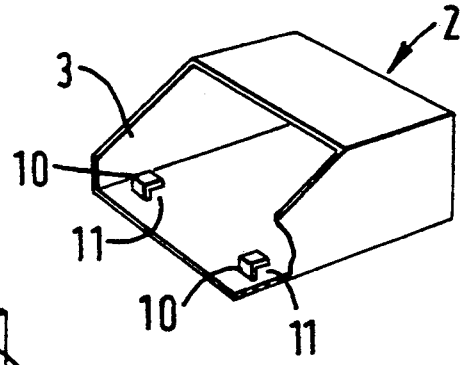
Figure 5A:
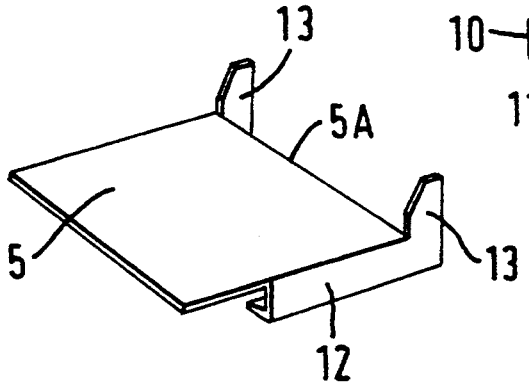

FIG. 5 (in which like parts are designated as for FIGS. 1 to 4) illustrates an alternative system for releasably engaging the anchor plate 5 with the casing 2. In this system both arrangement and release are technically simple operations, and moreover engagement only takes place after the parts have been properly and fully assembled together.

In more detail, at the lower edge of the mouth 3 of the casing there are provided two upstanding catch formations 10 of generally L-shaped cross-section, the free ends of which point into the casing to define with the lower wall of the casing a pair of channels 11 open towards the rear wall of the dispenser. The formations 10 are spaced slightly away (e.g. about 5 mm) from the casing side walls.

The anchor plate 5 carries on its underside catch means (not shown) corresponding to part 8 as described above in relation to FIGS. 1 to 4. Depending from the side edges of the anchor plate 5 and turning inwards to define mutually inwardly-open channels are two L-section flanges 12 (only one shown in FIG. 5). The flanges 12 extend past the rear edge 5A of the anchor plate and each ends with a side wing 13. The side wings 13 assist in guiding the stack over the rear edge 5A of the anchor plate. Furthermore, the wings 13 and flanges 12 are configured so as to assist the correct engagement of the anchor plate with the casing, as described in more detail below.

When the anchor plate 5 is inserted correctly into the casing the flanges 12 slide over the formations 10 of the lower wall of the casing and drop onto the lower wall of the casing when the anchor plate is fully inserted. The flanges 12 maintain the anchor plate in an orientation parallel to the lower wall of the casing and the formations 10 prevent the anchor plate from being slid out of the casing accidentally. To remove the anchor plate it is necessary first to lift the plate so that the flanges 12 pass over the formations 10, in a procedure which is the reverse of the assembly procedure.

Should the anchor plate be inserted upside down, the side wings 13 will pass into the casing, by virtue of the small space between each catch formation 10 and the casing side wall, but the anchor plate will neither releasably engage with the catch formations 10 nor lie parallel to the casing, by virtue of the configuration of the side wings 13.

The dispensers of FIGS. 1 to 5 can be mounted in situ in any desired fashion, with the casing mouth in a vertical, a horizontal or an inclined plane, and graded sizes of casings can be mounted one upon another so that overall a compact arrangement for dispensing different sizes of bags or sheets is obtained.

Speedy re-loading can be effected by replacing an empty anchor plate by an already loaded anchor plate, loading in itself being any easy task as only sliding of the anchor plate out of and into the casing is required.

Figure 6:
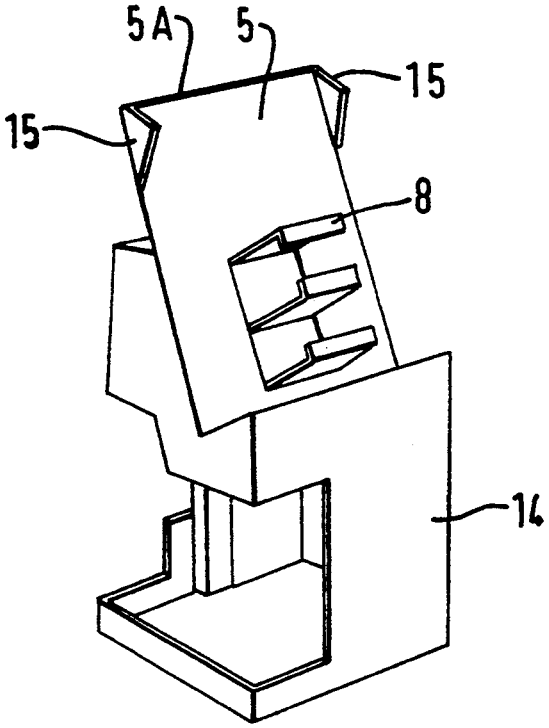
FIG. 6 is a perspective view of another dispenser for dispensing pre-formed bags or sheets.

In the further embodiment illustrated in FIG. 6, in which like parts are designated as for FIGS. 1 to 5, the anchor plate 5 is integral with the body part. In this embodiment the body takes the form of a free-standing base 14, configured so as to stand beside a chair at a supermarket check-out so that a check-out operator can easily obtain bags or sheet for packaging items of shopping.

The anchor plate 5 extends upwards from the base at a rather steep angle and terminates in an upper edge 5A, over which the stack of bags or sheets is folded.

The catch 8 is provided on the upper face of the anchor plate, and in the embodiment illustrated is arranged to accommodate a stack of relatively large plastic bags having a relatively large opening through which the catch 8 passes. The stack passes up from the catch means and over the upper edge 5A so that the free ends of the bags hang over the upper edge, where they can be easily grasped for removal.

Side wings 15 located to the sides of the upper edge 5A assist in guiding the stack over the edge.

In place of the part 8 of all the embodiments illustrated, alternative catch devices (e.g. a pair of L-shaped pins) can be provided suited to the stack of bags or sheets which are to be dispensed.

Folding of the stack around the anchor plate (or alternative stack support means) enhances single bag or sheet dispensing as the introduction of the fold creates friction and tension sufficient to prevent several bags being removed at the same time, whilst permitting easy removal of single bags or sheets. Moreover, the dispensers of the invention occupy less space for a given number of bags, as compared to conventional roll dispensers, and permit the dispensed bags to be more readily opened than roll bags (which are tightly packed onto the roll). From economic and environmental points of view, the dispensers of the invention are particularly advantageous in that it is generally impossible to remove more than a few bags at a time, whereas conventional roll dispensers can dispense a large number of bags in one "pull" by a user, causing significant waste.

What is claimed is:

1. A dispenser for dispensing individual pre-formed bags or sheets from a stack of such bags or sheets, the dispenser comprising:

a body part;

an anchor part for the stack disposed on or in the body part, the anchor part comprising:

catch means for engaging a stack of pre-formed bags or sheets; and stack support means for underlying and supporting a portion of the engaged stack;

whereby the anchor part is adapted to have a stack of pre-formed bags or sheets that is engaged with the catch means folded around said stack support means so that said stack extends from said catch means, passes over and around said support means so that free ends of the bags or sheets project from the dispenser for being grasped for removal.

2. A dispenser according to claim 1, in which the anchor part comprises an anchor plate carrying on one of its faces said catch means and extending from said catch means to define said stack support means.

3. A dispenser according to claim 1 or 2, in which the anchor part is releasably mounted to the body part.

4. A dispenser according to claim 2, in which:

said body part comprises a casing having side, upper and lower walls defining a mouth for receiving said anchor plate; whereby in use the stack of bags or sheets extends from said catch means away from the mouth of said casing, passes over and around said anchor plate and back to the mouth of said casing so that the free ends of said bags or sheets project from the dispenser for being grasped for removal.

5. A dispenser according to claim 4, in which said catch means is located on said anchor plate so as to be near the mouth of said casing.

6. A dispenser according to claim 4, in which said casing is disposed to retain said anchor plate substantially horizontally and said catch means is located to be to the underside of said anchor plate.

7. A dispenser according to claim 4, in which said anchor plate is provided with flanges adapted to slidingly engage said side walls of the casing, said flanges being further adapted to releasably engage cooperating formations provided on said casing lower walls when said anchor plate and said casing are properly and fully assembled together.

8. A dispenser according to claim 1, in which:

said body part comprises a base part on which said anchor part is fixedly disposed and from which said stack support means extends; and said catch means is provided relatively close to said body part;

whereby in use the stack of bags or sheets extends from said catch means away from said base part and passes over and around said stack support means to hang over the said support means for being grasped for removal.

9. A dispenser according to claim 8, in which the anchor part comprises an anchor plate extending upwards from the base of the dispenser at an angle to the vertical to define the support means for the stack, and said catch means is located so as to be on the upper side of the anchor plate.

10. A dispenser according to claim 1, in which said anchor part is provided with side wings associated with said stack support means that serve as guides for guiding the stack of bags or sheets over and around said stack support means.

* * * * *